US008215916B2

(12) United States Patent
Koga et al.

(10) Patent No.: US 8,215,916 B2
(45) Date of Patent: Jul. 10, 2012

(54) AXIAL FLOW FAN

(75) Inventors: Kiyonori Koga, Chiyoda-ku (JP); Shoji Yamada, Chiyoda-ku (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 1084 days.

(21) Appl. No.: 12/114,020

(22) Filed: May 2, 2008

(65) Prior Publication Data

US 2009/0004019 A1 Jan. 1, 2009

(30) Foreign Application Priority Data

Jun. 28, 2007 (JP) ..... 2007-170273

(51) Int. Cl.
*F01D 5/12* (2006.01)

(52) U.S. Cl. ..... 416/223 R; 416/223 A; 416/242; 416/243; 416/DIG. 2; 416/DIG. 5

(58) Field of Classification Search ..... 416/223 R, 416/223 A, 242, 243, DIG. 2, DIG. 5
See application file for complete search history.

(56) References Cited

U.S. PATENT DOCUMENTS

| | | | | |
|---|---|---|---|---|
| 3,140,042 | A * | 7/1964 | Fujii | 416/243 |
| 4,585,395 | A * | 4/1986 | Nourse et al. | 416/223 A |
| 4,911,612 | A * | 3/1990 | Rodde et al. | 416/223 R |
| 5,088,892 | A * | 2/1992 | Weingold et al. | 415/193 |
| 6,264,429 | B1 * | 7/2001 | Koeller et al. | 416/223 A |
| 6,287,078 | B1 * | 9/2001 | Min et al. | 416/189 |
| 6,382,921 | B1 * | 5/2002 | Selig et al. | 416/243 |
| 6,739,835 | B2 | 5/2004 | Kim | |
| 2002/0085918 | A1 * | 7/2002 | Olhofer et al. | 416/223 A |
| 2006/0275134 | A1 * | 12/2006 | Hasenjager et al. | 416/237 |

FOREIGN PATENT DOCUMENTS

| | | | |
|---|---|---|---|
| EP | 1 574 716 | A1 | 9/2005 |
| JP | 32-10477 | Y | 9/1957 |
| JP | 07-012094 | A | 1/1995 |
| JP | 07-119693 | A | 5/1995 |
| JP | 10-089289 | A | 4/1998 |
| JP | 2001-234893 | A | 8/2001 |
| JP | 2003-074495 | A | 3/2003 |
| JP | 2005-282567 | A | 10/2005 |

OTHER PUBLICATIONS

Office Action from Japanese Patent Office issue in Applicant's corresponding Japanese Patent Application No. 2007-170273 dated Mar. 10, 2009, with English translation.

* cited by examiner

*Primary Examiner* — Igor Kershteyn
(74) *Attorney, Agent, or Firm* — Buchanan Ingersoll & Rooney PC

(57) ABSTRACT

The axial flow fan includes a plurality of blades disposed around and rotating together with the rotation shaft, the blades each including a leading edge, a trailing edge, a leading edge portion proximate the leading edge, a trailing edge portion proximate the trailing edge, a suction surface, a pressure surface, the suction surface having a curved shape; wherein the blade trailing edge portion has a constant thickness; and the trailing edge is formed in a semi-circle which is bi-sected by a mean camber line of the air foil.

2 Claims, 4 Drawing Sheets

AXIAL FLOW FAN

FIELD OF THE INVENTION

The present invention relates to axial flow fans and more particularly to a blade of the axial flow fan that improves efficiency of the axial flow fan for use with a rotating electrical machine and that increases structural strength and workability/formability at a trailing portion of the axial flow fan blade.

BACKGROUND OF THE INVENTION

Generally, in an axial flow fan for use as a cooling fan for a rotating electrical machine, there is employed an airfoil—a cross-sectional shape of a blade-on the basis of National Advisory Committee for Aeronautics series airfoil (hereinafter referred to as NACA airfoil or NACA airfoil shape). The NACA airfoil is formed in such a way that a trailing portion thereof is progressively thinner toward a trailing edge thereof; thus, the structural strength of the thin trailing portion is weak, which makes it hard to work or form the portion. For this reason, generally, an airfoil without the thin trailing portion thereof is used.

Japanese Unexamined Patent Publication 2003-74495 (paragraphs 0018 through 0026; FIG. 3) discloses an airfoil having a trailing portion identical with that of the NACA airfoil and comprising an anti-turbulence element while the thickness in the midsection of the airfoil is made thinner than that of the NACA airfoil.

The airfoil as disclosed in Japanese Unexamined Patent Publication 2003-74495 is based upon the NACA airfoil; however, the trailing portion is identical with that of the NACA airfoil, which does not assure the strength of a thin trailing portion or overcome difficulty in working or forming the trailing portion.

Furthermore, in the airfoil in which the thin trailing portion thereof is omitted, an airfoil length—a distance between the leading edge and the trailing edge of the airfoil—is short, which reduces the volume of air stream [flowing along a pressure surface, and a suction surface, of the airfoil], to thereby decrease the pressure differential between both surfaces. A problem has been that a smaller stagger angle for the purpose of compensating for decrease in air stream volume and pressure differential causes reduction of the efficiency of the axial flow fan.

The present invention is directed to overcome the forgoing problems, and an object of the invention is to provide an axial flow fan having an airfoil that improves the efficiency of the axial flow fan and increases the strength and workability/formability of the thin trailing portion.

SUMMARY OF THE INVENTION

The axial flow fan according to the present invention includes a blade having a suction surface and a pressure surface. The suction surface profile is identical with a predetermined airfoil shape, for example, an airfoil including an NACA-series airfoil; a trailing edge portion on the pressure surface is modified from that of the predetermined airfoil. A feature is that a blade trailing edge portion between the trailing edge portions on the oppositely facing pressure and suction surfaces, has a thickness greater than that of a blade trailing edge portion according to the predetermined airfoil, and has the thickness to provide structural strength equaling or exceeding a predetermined strength.

The axial flow fan according to the present invention, thus, allows the efficiency thereof to be increased and also the structural strength and workability/formability of the airfoil trailing edge portion to be improved.

These and other objects of the present invention will be better understood by reading the following detailed description in combination with the attached drawings of a preferred embodiment of the invention.

DESCRIPTION OF THE PREFERRED EMBODIMENT

Embodiment 1

Figure 1:
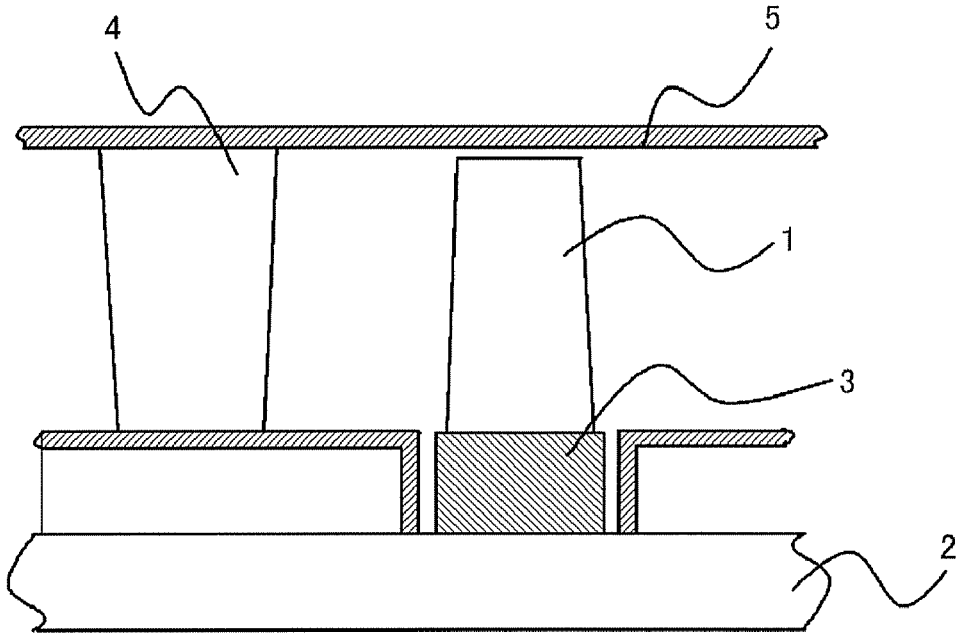
FIG. 1 is a view illustrating a blade portion of an axial flow fan according to Embodiment 1 of the present invention.

FIG. 1 is a view illustrating an axial flow fan according to Embodiment 1 of the present invention; A blade 1 is mounted on a hub 3 coupled to a rotating shaft 2 of the axial flow fan, being driven to rotate by a drive apparatus (not shown) that drives the rotating shaft 2. A stationary vane 4 is mounted on a casing 5. The casing 5 surrounds the blade 1, the stationary vane 4, and the hub 3, to form a passageway for air flow in the axial flow fan.

Figure 2:
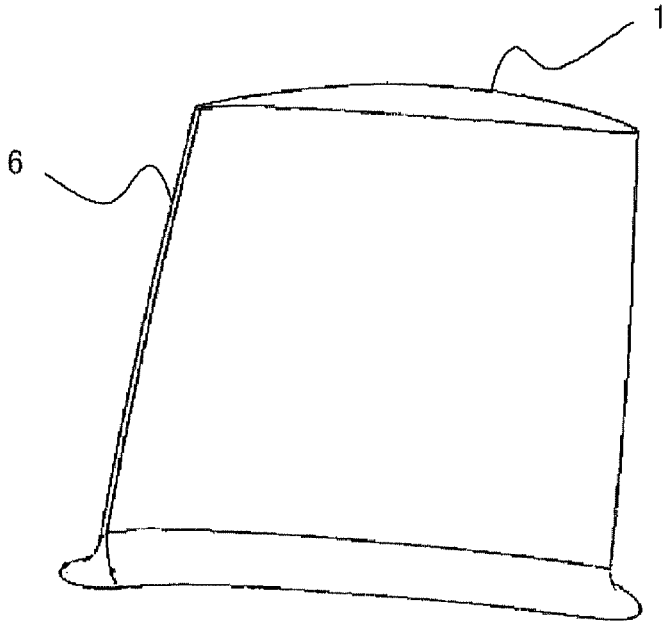
FIG. 2 is a top perspective view of a blade in Embodiment 1.
Figure 3:
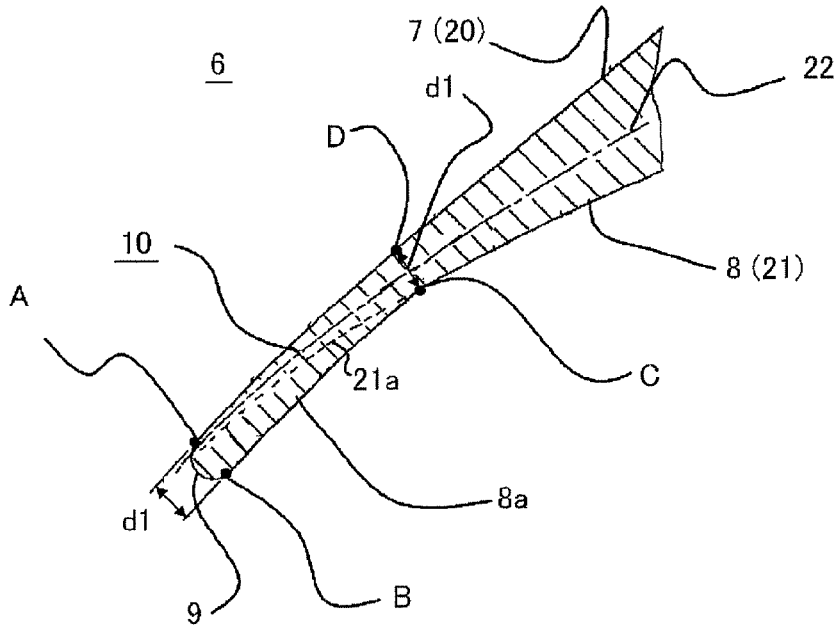
FIG. 3 is a view illustrating an airfoil shape of a blade trailing portion in FIG. 2.

FIG. 2 is a top perspective view of a blade in Embodiment 1; FIG. 3 is a view illustrating an airfoil shape of a trailing portion of the blade as shown in FIG. 2. In a trailing portion 6 as shown in FIG. 3, a suction surface is designated at numeral 7, a pressure surface at numeral 8, a trailing edge portion on the pressure surface at numeral 8*a*, and a trailing edge surface thereof at numeral 9. An airfoil of the blade 1, which is based upon the NACA airfoil, is formed into a shape modified from the NACA airfoil shape with respect to the trailing portion 6. It is to be noted that FIG. 3 depicts the blade 1 airfoil and the NACA airfoil that are superimposed one upon another, and an NACA airfoil portion differing from the blade 1 airfoil is shown in a phantom line. Where the blade 1 airfoil and NACA airfoil are superimposed one on another, reference numerals corresponding to the NACA airfoil are shown in parentheses. Further figures and reference numerals with respect to the NACA airfoil will be shown in the same way.

A suction surface 20 of the NACA airfoil coincides with the suction surface 7 of the blade 1 airfoil; however, a pressure surface 21 of the NACA airfoil differs from the pressure surface 8 of the blade 1 airfoil with respect to a blade portion toward the trailing edge, and progressively approaches the suction surface 20 toward the blade trailing edge. The centerline (mean camber line) of the NACA airfoil is designated at numeral 22. A boundary C is located where the pressure surface 21 of the NACA airfoil coincides with the pressure surface 8 of the blade 1 airfoil. It is to be noted that the boundary Cis also a boundary between the trailing edge portion 8*a* on the pressure surface 8 and a partially illustrated portion toward the leading edge (not shown in the figures except FIG. 2, where the leading edge is not labeled) on the pressure surface 8. A boundary D represents a boundary where a line perpendicular to the blade centerline 22 intersects the suction surface 20 while the boundary C represents a boundary where the line intersects the pressure surface 21. Designated at numeral 21*a* is a trailing edge portion on the pressure surface of the NACA airfoil, extending toward the trailing edge from the boundary C.

The suction surface 7 of the blade 1 airfoil coincides with the NACA airfoil suction surface 20; a surface portion extending toward the leading edge from the boundary C on the pressure surface 8 coincides with the NACA airfoil pressure surface 21; thus, the boundary D is also a boundary where a line perpendicular to the centerline of the blade 1 intersects the suction surface 7. A portion extending toward the trailing edge from the boundary C on the pressure surface 8 and from the boundary D on the suction surface 7 is defined as a blade trailing edge portion 10.

The boundary C needs to be selected to be farther toward the leading edge than a boundary of the thin trailing edge portion where the NACA airfoil lacks strength. Furthermore, the boundary C where the thin portion has insufficient strength will vary according to a rotational speed of an axial flow fan, and fluid to be discharged from or drawn in the fan; thus, the location of the boundary C needs to be selected appropriately with some margin of safety.

In the NACA airfoil, the thickness of trailing portion between the pressure surface 21 and the suction surface 20 is progressively thinner toward the blade trailing edge; as the trailing edge approaches, the strength of the airfoil trailing portion is lowered, which makes it hard to form into a predetermined shape in which a reduced strength portion is extended or expanded. Consequently, in Embodiment 1, in order to improve the structural strength and workability/formability of the blade trailing edge portion 10 including a portion corresponding to the NACA airfoil thin trailing edge portion, a thickness of the trailing edge portion—i.e., the thickness of the blade trailing edge portion 10 between the trailing edge portion 8*a* on the pressure surface 8 and the trailing portion on the suction surface 7, facing to each other—is defined as a constant thickness d1. The edge portion of the thickness d1 has structural strength equaling or exceeding a predetermined strength calculated from a blade lifetime that takes into consideration an environment where an axial flow fan is used. The shape of the suction surface 7 is defined as being identical with that of the NACA airfoil suction surface 20 so that reduction of the efficiency of the axial flow fan may not result. The trailing edge 9 may be shaped, for example, in such a way that an archery bow is formed between the outermost end A of the trailing edge portion on the suction surface 7 toward the trailing edge (here, the outermost end is henceforward referred to as the distal end or first end) and the distal end B of the trailing edge portion on the pressure surface 8.

In the airfoil of the blade 1, the airfoil of the suction surface 7 is made to be identical with that of the NACA airfoil, while the airfoil of the pressure surface 8 is modified from the NACA airfoil with respect to only the trailing edge portion 8*a*; thus, a turbulent separated flow occurring at the trailing edge portion on account of the shape modification can be maintained at a minimum. As a result, the axial flow fan including a blade having the above-described airfoil shape can achieve a fan operating performance and a fan efficiency that compares favorably with those of the NACA airfoil.

Furthermore, since the airfoil having a basic performance exhibited by the NACA airfoil is applied to the axial flow fan, building a prototype of an axial flow fan to thereby verify its performance is not needed; shape modification and adjustment do not need to be made repeatedly, either. This enables elimination of costs and time for building a prototype of the axial flow fan blade 1, thus allowing for shortening of the time period for development of the axial flow fan, and also achieving reduction of the development cost.

As discussed thus far, the axial flow fan in Embodiment 1 has the blade 1 suction surface 7 identical with that of the predetermined airfoil; the trailing edge portion 8*a* of the blade 1 pressure surface 8 is modified from the predetermined airfoil; the blade trailing edge portion 10 has a thickness to provide structural strength equaling or exceeding the predetermined strength, whereby the fan efficiency can be improved, and the strength and workability/formability of the airfoil trailing edge can be enhanced.

Embodiment 2

Figure 4:
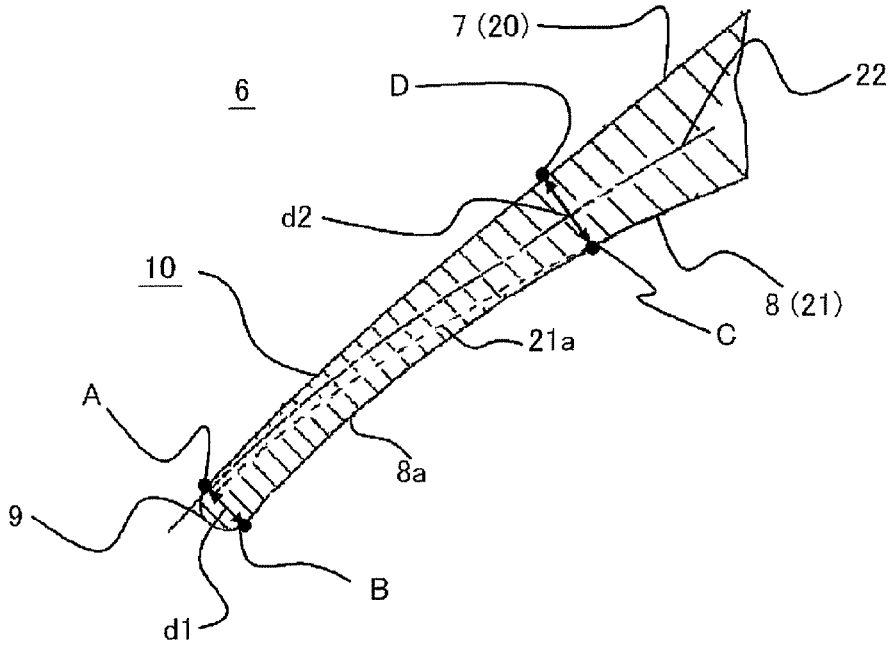
FIG. 4 is a view illustrating a blade trailing portion of an axial flow fan according to Embodiment 2 of the present invention.

FIG. 4 is a view illustrating a blade trailing edge portion of an axial flow fan according to Embodiment 2 of the present invention; FIG. 4 differs from the figure in Embodiment 1 in that the thickness of the distal end of the trailing edge portion 10 and the thickness of the innermost end of the trailing edge portion 10 toward the leading edge are modified, so that the trailing edge portion 8*a* on the pressure surface merges smoothly with the pressure surface 8. Here, the innermost end is henceforward referred to as the proximal end or the second end. It is to be noted that FIG. 4 depicts the airfoil of the blade 1 and the NACA airfoil, superimposed one upon another, where an NACA airfoil portion differing from the blade airfoil is indicated in a phantom line.

The distal end thickness of the blade trailing edge portion 10 is a thickness d1—i.e. the thickness of the trailing edge; the proximal end thickness of the trailing edge portion 10 is a thickness d2—i.e. the thickness at the boundary D—greater than the thickness d1; the thickness d1 is made to progressively vary (or increase) toward the leading edge from the trailing edge portion—for example, the thickness d1 can be made to increase in a linear manner. With this arrangement, the trailing edge portion 8*a* on the pressure surface merges smoothly with the leading edge portion extending toward the leading edge from the proximal end of the trailing edge portion 8*a*. Thus, the separated flow in the trailing edge portion can be reduced in comparison with that in Embodiment 1. Moreover, since the proximal end thickness d2 of the blade 1 trailing edge portion is greater than the thickness d1, the boundaries C and D are located farther toward the leading edge than those in Embodiment 1; as a result, the structural strength of the blade trailing edge portion 10 can be enhanced when compared with that in Embodiment 1.

Figure 5:
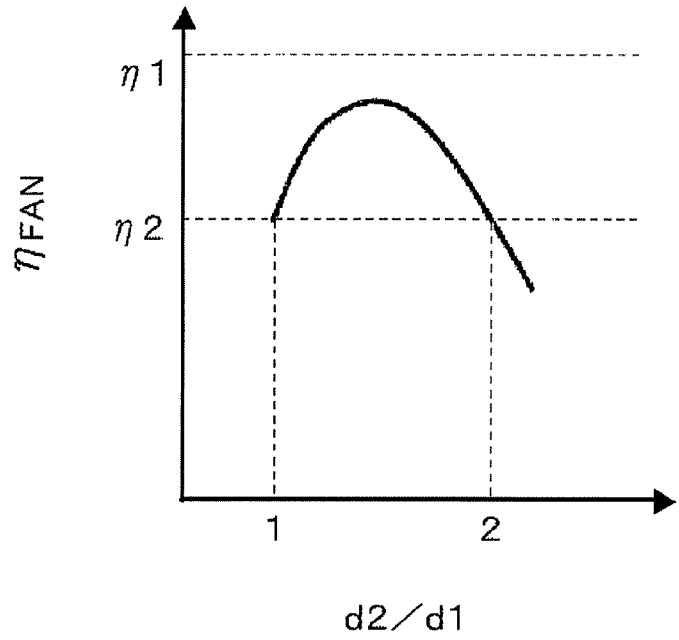
FIG. 5 is a graph illustrating a relationship between fan efficiency and the thickness of a blade trailing edge portion, of the axial flow fan according to Embodiment 2 of the present invention.

FIG. 5 is a graph illustrating a relationship between fan efficiency and the thickness of a blade trailing edge portion 10 of the axial flow fan. The horizontal axis represents a thickness ratio of the blade trailing edge portion 10, i.e., d2/d1, while the vertical axis represents a fan efficiency ηFAN of the axial flow fan. Symbol η1 as shown in FIG. 5 represents the fan efficiency when using the NACA airfoil; η2 represents the fan efficiency when the thickness ratio d2/d1 is a value of one (1). Here, the thickness ratio d2/d1, when equal to a value of one (1), corresponds to that in Embodiment 1.

Increasing the thickness ratio d2/d1 enhances the fan efficiency, thus approximating the fan efficiency η1 that the NACA airfoil, when used, achieves. Further increase of the ratio d2/d1 will, in turn, cause the fan efficiency to lower. When the ratio d2/d1 reaches a value of two (2), the fan efficiency becomes η2; further increasing the ratio d2/d1 will cause the fan efficiency to lower more than the efficiency exhibited in Embodiment 1. Thus, it is preferable that the thickness ratio d2/d1 be selected within a range of a minimum of one (1) and a maximum of two (2).

Here, the foregoing discussion refers to a case where the thickness of the trailing edge portion increases in a linear manner toward the leading edge from the trailing edge portion; however, the thickness may maintain the constant thickness d1 up to the intermediate point of the trailing edge portion and thereafter increase progressively. Even in such a case, the trailing edge portion 8*a* on the pressure surface can merge smoothly with the pressure surface 8; moreover, the change in thickness of the trailing edge portion is not limited to a linearly increasing change.

Embodiment 3

Figure 6:
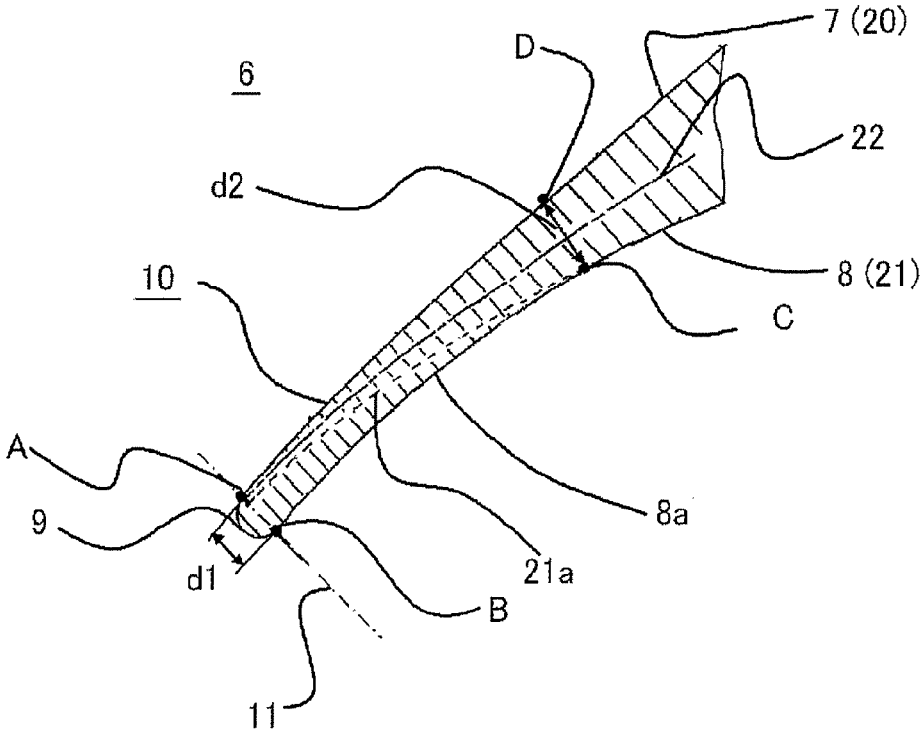
FIG. 6 is a view illustrating a blade trailing portion of an axial flow fan according to Embodiment 3 of the present invention.
Figure 7:
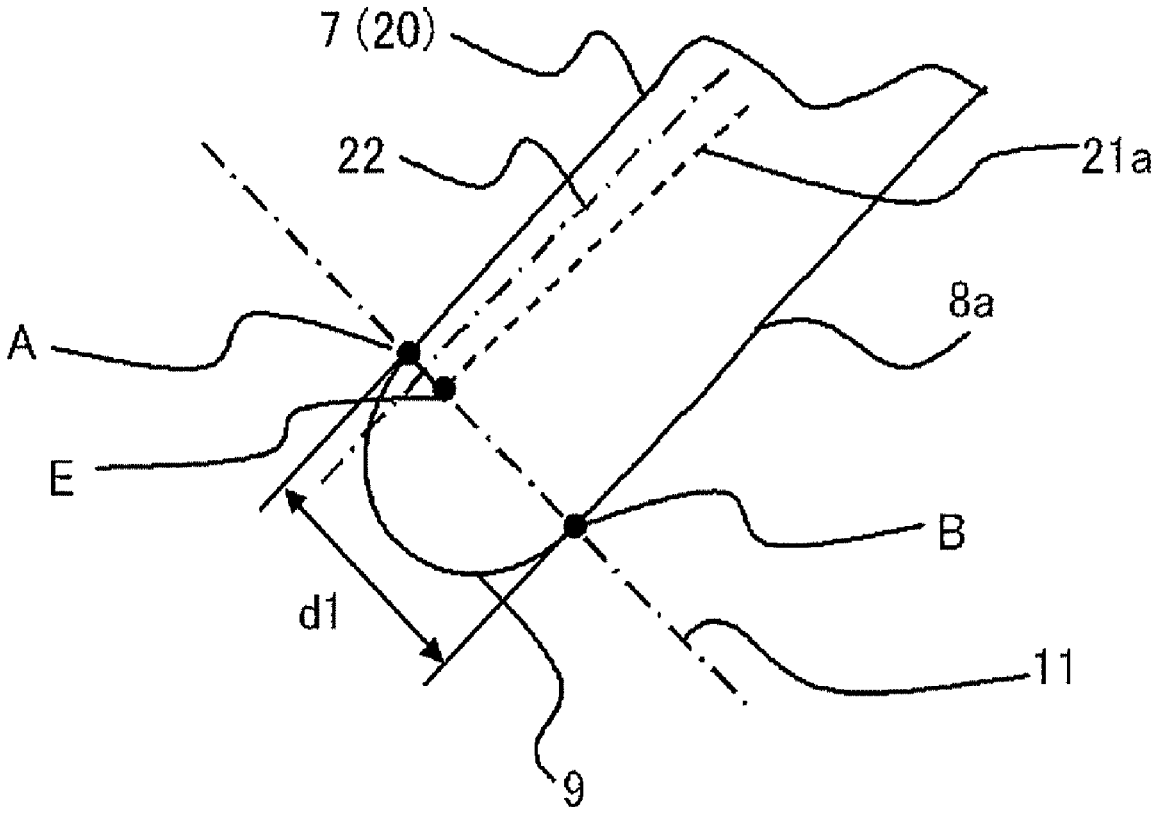
FIG. 7 is an enlarged view of a portion located toward the trailing edge of the blade trailing edge portion in FIG. 6.

FIG. 6 is a view illustrating a blade trailing edge portion of an axial flow fan according to Embodiment 3 of the present invention; FIG. 7 is an enlarged view of a portion located toward the trailing edge of the blade trailing edge portion in FIG. 6; FIG. 6 differs from FIG. 5 in Embodiment 2 in that the blade trailing edge portion can be formed in that [because all the trailing edge portion 8*a* on the pressure surface is curved] the trailing edge portion 8*a* merges more smoothly with the leading edge portion on the pressure surface 8 than the example in Embodiment 2. It is to be noted that FIGS. 6 and 7 illustrate the airfoil of the blade 1 and NACA airfoil that are superimposed one upon another, where an NACA airfoil portion different from the blade 1 airfoil is shown in a phantom line.

The airfoil of the blade 1 in Embodiment 3 is defined as below. The airfoil of the blade 1 is made to be identical with the NACA airfoil with respect to the shape on the suction surface 7, while the shape of the pressure surface 8 is modified from the NACA airfoil with respect to only the trailing edge portion 8*a* on the pressure surface. A distal end A of the suction surface is located to be identical with a trailing edge of the suction surface of the NACA airfoil; a predetermined thickness d1 is defined between the distal end A and a distal end B; the distal end B is selected so as to be in a line 11 along the trailing edge surface of the NACA airfoil—i.e., the line 11 connecting the distal end A with the trailing edge E of the NACA airfoil pressure surface. Here, the blade thickness represents a distance—measured along a direction orthogonal to the blade centerline—between the suction surface 7 and the pressure surface 8 of the airfoil; thus, the distal end line 11 is also a line orthogonal to the blade centerline defining the thickness d1 of the portion located toward the trailing edge.

Next, a point located in the distal end line 11 of the NACA airfoil and in the pressure surface side is selected as the center O (not shown); the shape of the trailing edge portion 8*a* on the pressure surface is formed into a circular arc having its center in the center O. At this time, the boundary C between the trailing edge portion 8*a* on the pressure surface and a portion toward the leading edge on the pressure surface 8 is selected so that the thickness of the proximal end of the blade trailing edge portion 10 is a predetermined thickness d2. The trailing edge surface 9 can be made in such a way that, for example, a semi-circle is formed between the distal end A of the suction surface 7 and the distal end B of the pressure surface 8.

Even though the proximal end thickness d2 of the blade trailing edge portion 10 is selected arbitrarily, the foregoing method enables the portion 10 to merge smoothly, in the boundary C on the pressure surface 8, with the portion located toward the leading edge on the pressure surface 8.

As discussed above, when compared with the case in Embodiment 2, the trailing edge portion 8*a* on the pressure surface can merge smoothly with a portion farther forward toward the leading edge from the trailing edge portion 8*a*. This enables reduction of the separated flow in comparison with that in Embodiment 2, thus resulting in enhancement of the efficiency of the axial flow fan. Moreover, an advantage of this embodiment is that the shape of the trailing edge portion 8*a* on the pressure surface is unambiguously defined by determining the distal end thickness d1 and the proximal end thickness d2 of the blade 1 trailing edge portion 10.

While the examples in which Embodiment 1 through Embodiment 3 use the NACA airfoil as the predetermined airfoil have been described, the embodiments are also applicable to the modification of generally any other airfoil having a trailing portion that is made progressively thinner toward the edge. Furthermore, the example in which the modified airfoil is applied to the blade of the axial flow fan has been described; the modified airfoil is also applicable to the stationary vane of the axial flow fan. While the present invention has been shown and described with reference to preferred embodiments thereof, it will be understood by those skilled in the art that various modifications and the like could be made thereto without departing from the spirit and scope of the invention.

What is claimed is:

1. An axial flow fan, comprising:

a rotation shaft capable of rotating;

a plurality of stationary vanes disposed around the rotation shaft; and a plurality of blades disposed around and rotating together with the rotation shaft, the blades each including a leading edge, a trailing edge, a leading edge portion proximate the leading edge, a trailing edge portion proximate the trailing edge, a suction surface, a pressure surface, the suction surface having a curved shape;

wherein the blade trailing edge portion has a constant thickness; and the trailing edge is formed in a semi-circle which is bisected by a mean camber line of the air foil.

2. The axial flow fan of claim 1, wherein the trailing edge portion on the pressure surface merges smoothly with a leading edge portion extending toward a leading edge from the trailing edge portion, and a thickness ratio of a numerator to a denominator is from 1 to 2 when the denominator represents a thickness selected from a first end thickness range of the blade trailing edge portion and the numerator represents a thickness selected from a second end thickness range of the blade trailing edge portion.

* * * * *